US008251668B2

(12) United States Patent
Kasperski

(10) Patent No.: US 8,251,668 B2
(45) Date of Patent: Aug. 28, 2012

(54) METHOD AND APPARATUS FOR ASSEMBLING ROTATING MACHINES

(75) Inventor: Donald Joseph Kasperski, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 609 days.

(21) Appl. No.: 12/494,764

(22) Filed: Jun. 30, 2009

(65) Prior Publication Data

US 2010/0329872 A1 Dec. 30, 2010

(51) Int. Cl.
*F01D 5/30* (2006.01)
*F04D 29/34* (2006.01)

(52) U.S. Cl. ..... 416/219 R; 416/204 A; 29/888.02; 29/888.025; 29/889.7

(58) Field of Classification Search ..... 416/204 A, 416/219 R, 219 A, 223 A, 244 R, 244 A, 416/220 R, 248; 29/888.02, 888.025, 889.2, 29/889.21, 889.7
See application file for complete search history.

(56) References Cited

U.S. PATENT DOCUMENTS

| | | | | |
|---|---|---|---|---|
| 2,846,183 | A * | 8/1958 | Morgan | 416/221 |
| 3,137,478 | A * | 6/1964 | Farrell | 416/220 R |
| 4,389,161 | A | 6/1983 | Brumen | |
| 4,444,544 | A | 4/1984 | Rowley | |
| 4,566,857 | A | 1/1986 | Brumen | |
| 5,022,822 | A * | 6/1991 | Sincere | 416/219 R |
| 5,131,813 | A | 7/1992 | Przytulski et al. | |
| 5,131,814 | A | 7/1992 | Przytulski et al. | |
| 5,277,548 | A | 1/1994 | Klein et al. | |
| 5,370,501 | A * | 12/1994 | Udall | 416/216 |
| 5,486,095 | A * | 1/1996 | Rhoda et al. | 416/214 A |
| 5,611,669 | A | 3/1997 | Royle | |
| 6,416,282 | B1 * | 7/2002 | Beeck et al. | 416/97 R |
| 7,104,759 | B2 | 9/2006 | Tipton et al. | |
| 7,309,215 | B2 * | 12/2007 | Negulescu | 416/220 R |
| 2008/0273982 | A1 | 11/2008 | Chunduru et al. | |

FOREIGN PATENT DOCUMENTS

JP 59226202 A * 12/1984

* cited by examiner

*Primary Examiner* — Edward Look
*Assistant Examiner* — Ryan Ellis
(74) *Attorney, Agent, or Firm* — Armstrong Teasdale LLP

(57) ABSTRACT

A method for assembling a rotating machine and a blade attachment mechanism are provided. A first dovetail slot having a first axial length and a second dovetail slot having a second axial length are each formed in the attachment mechanism such that the second dovetail slot is radially outboard of the first dovetail slot. First axial length is greater than the second axial length and each slot is substantially parallel to an axial centerline of the rotating machine. A first dovetail lobe having a third axial length that is shorter than the first axial length and a second dovetail lobe having a fourth axial length, shorter than the first axial length and longer than the third axial length, are each formed in the attachment mechanism and positioned to correspond with first and second dovetail slot, respectively, such that the second dovetail lobe is radially outward from the first dovetail lobe.

17 Claims, 13 Drawing Sheets

METHOD AND APPARATUS FOR ASSEMBLING ROTATING MACHINES

BACKGROUND OF THE INVENTION

The embodiments described herein relate generally to rotating machines and, more particularly, to methods and apparatus for assembling turbine engines.

At least some known turbine engines include a plurality of rotating turbine blades or buckets that channel high-temperature combustion gas stream through gas turbine engines or channel high-temperature steam through steam turbine engines. Known buckets are typically coupled to a rotor within the turbine engine and cooperate with the rotor to form a turbine section. Moreover, these known buckets increase in radial length as a function of axial position on the rotor at least partially forming a divergent turbine hub on the rotor. At least some of the known gas turbine engines also include a plurality of rotating compressor blades that channel air through the gas turbine engine. These known compressor blades are typically coupled to the rotor and cooperate with the rotor to form a compressor section. Moreover, these known compressor blades decrease in radial length as a function of axial position on the rotor at least partially forming a divergent compressor hub on the rotor.

Many of these known turbine buckets and compressor blades include dovetail sections inserted into dovetail grooves defined within the rotor. Such dovetail grooves and inserted dovetail sections are typically assembled to form a plurality of rows. Each row of buckets defines a turbine stage and each row of blades defines a compressor stage. Both the turbine hub and the compressor hub include a predetermined extended length to facilitate axial installation and axial removal of the buckets and the blades, respectively. Such extended length increases an overall length and weight of the turbine section and the compressor section and increases capital costs of construction. Moreover, the increased weight of the turbine section and the compressor section may induce an increase in centrifugal forces acting on the rotor for a range of operational speeds. Such an increase in forces acting on the rotor may increase inspection and maintenance costs. Further, the increased weight may cause additional fuel usage to accelerate and maintain a speed of the rotor. Such an increase in fuel usage may increase operational costs.

BRIEF DESCRIPTION OF THE INVENTION

This Brief Description is provided to introduce a selection of concepts in a simplified form that are further described below in the Detailed Description. This Brief Description is not intended to identify key features or essential features of the claimed subject matter, nor is it intended to be used as an aid in determining the scope of the claimed subject matter.

In one aspect, a method for assembling a rotating machine is provided. The method includes providing a rotating element. The method also includes forming a first dovetail slot having a first axial length within a portion of a rotating element. The first dovetail slot is substantially parallel to an axial centerline of the rotating element. The method further includes forming a second dovetail slot having a second axial length within a portion of the rotating element. The second dovetail slot is substantially parallel to the axial centerline of the rotating element. At least a portion of the second dovetail slot is radially outboard of at least a portion of the first dovetail slot. The first axial length is greater than the second axial length. The method also includes enclosing at least a portion of the rotating element within at least a portion of a casing.

In another aspect, a blade attachment mechanism for a rotating machine is provided. The rotating machine has a rotating element that in turn has an axial centerline. The blade attachment mechanism is at least partially formed within the rotating element. The blade attachment mechanism defines a first dovetail slot that in turn defines a first axial length that is parallel to the axial centerline. The blade attachment mechanism also defines a second dovetail slot that in turn defines a second axial length parallel to the axial centerline. The first axial length is greater than the second axial length and at least a portion of the second dovetail slot extends over at least a portion of the first dovetail slot.

In another aspect, a turbine engine is provided. The turbine engine includes a rotating element having an axial centerline. The engine also includes a blade attachment mechanism that is at least partially formed within the rotating element. The blade attachment mechanism defines a first dovetail slot that in turn defines a first axial length that is parallel to the axial centerline. The blade attachment mechanism also defines a second dovetail slot that in turn defines a second axial length parallel to the axial centerline. The first axial length is greater than the second axial length and at least a portion of the second dovetail slot extends over at least a portion of the first dovetail slot.

BRIEF DESCRIPTION OF THE DRAWINGS

The embodiments described herein may be better understood by referring to the following description in conjunction with the accompanying drawings.

DETAILED DESCRIPTION OF THE INVENTION

Figure 1:
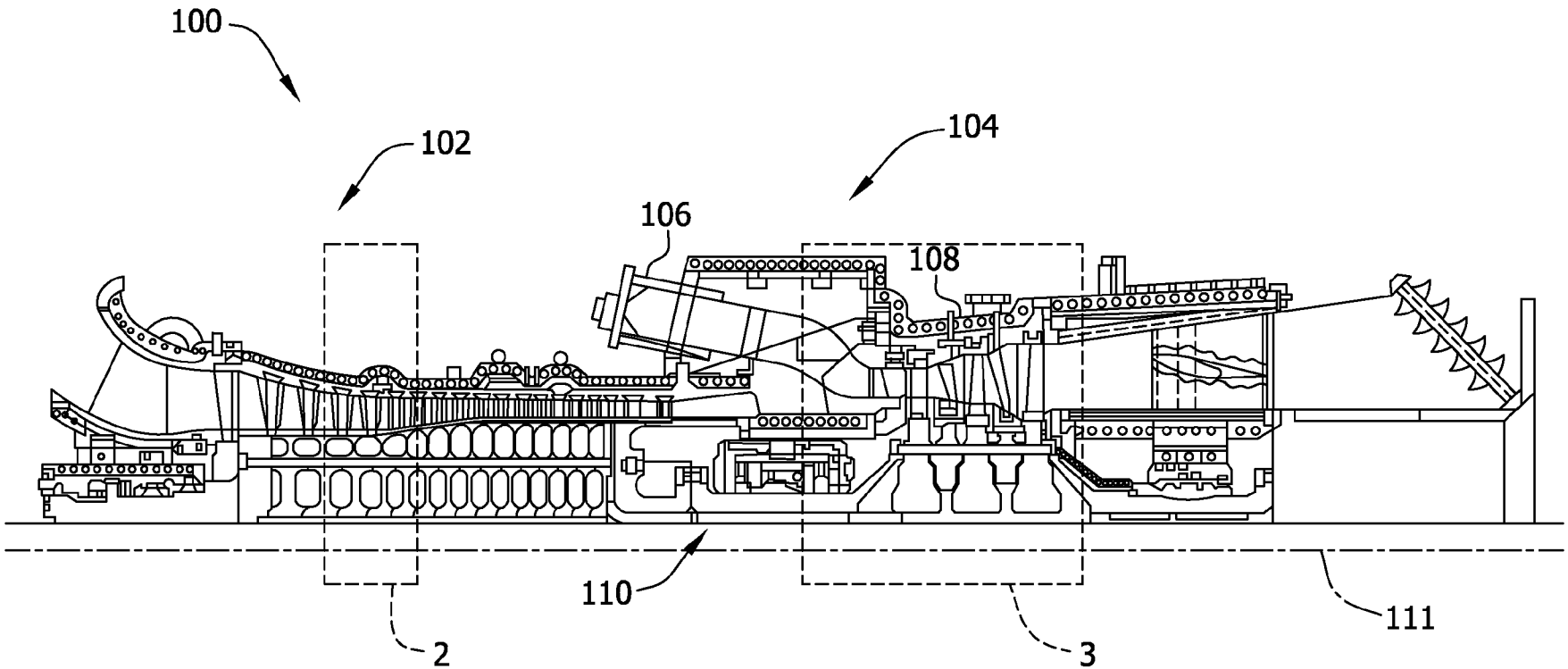
FIG. 1 is a schematic diagram of an exemplary turbine engine.

FIG. 1 is a schematic diagram of a rotating machine, i.e., a turbine engine, and more specifically, an exemplary gas turbine engine 100. Engine 100 includes a compressor 102 and a plurality of combustors 104. Each combustor 104 includes a fuel nozzle assembly 106. In the exemplary embodiment, engine 100 also includes a turbine 108 and a common compressor/turbine rotor 110 (sometimes referred to as rotor 110). Rotor 110 defines a rotor axial centerline 111. In one embodiment, engine 100 is a MS9001E engine, sometimes referred to as a 9E engine, commercially available from General Electric Company, Greenville, S.C.

Figure 2:
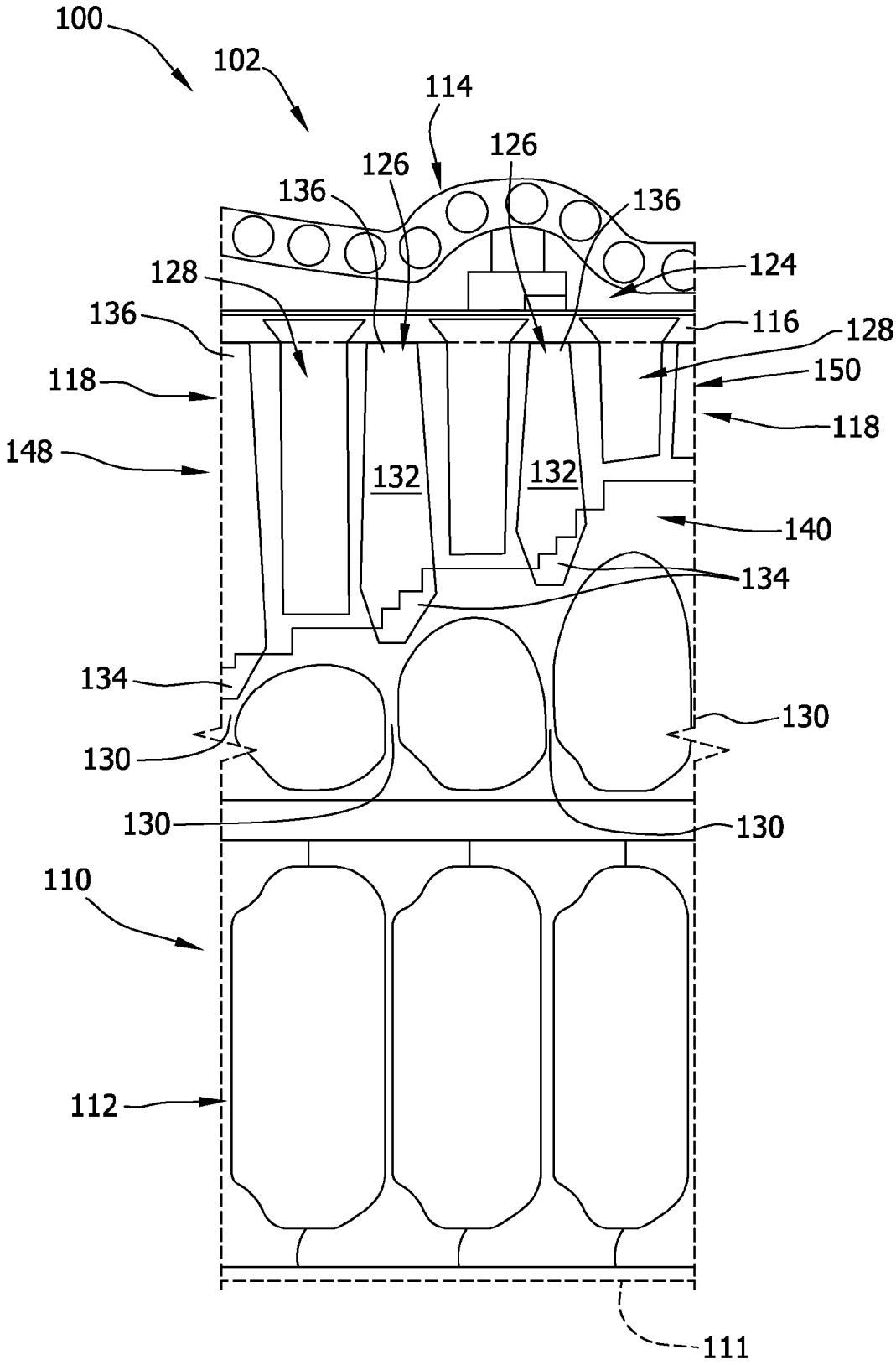
FIG. 2 is an enlarged cross-sectional view of a portion of a compressor that may be used with the gas turbine engine shown in FIG. 1 and taken along area 2.

FIG. 2 is an enlarged cross-sectional view of a portion of compressor 102 used with gas turbine engine 100 and taken along area 2 (shown in FIG. 1). Compressor 102 includes a compressor rotor assembly 112 and a compressor stator assembly 114 that are positioned within a compressor casing 116 that at least partially defines a flow path 118. In the exemplary embodiment, compressor rotor assembly 112 forms a portion of rotor 110. Moreover, in the exemplary embodiment, compressor 102 is substantially symmetrical about rotor axial centerline 111. Also, in the exemplary embodiment, compressor 102 is a portion of gas turbine engine 100. Alternatively, compressor 102 is any rotating, bladed, multi-stage fluid transport apparatus including, but not limited to, a stand-alone fluid compression unit and a fan.

Compressor 102 includes a plurality of stages 124, wherein each stage 124 includes a row of circumferentially-spaced rotor blade assemblies 126 and a row of stator blade assemblies 128, sometimes referred to as stator vanes. In the exemplary embodiment, rotor blade assemblies 126 are coupled to a compressor rotor wheel 130 via a stepped blade coupling or attachment mechanism 134 such that each blade assembly 126 extends radially outwardly from compressor rotor wheel 130. Also, in the exemplary embodiment, a plurality of compressor rotor wheels 130 and a plurality of stepped blade attachment mechanisms 134 at least partially define a substantially convergent compressor hub 140. Moreover, each assembly 126 includes a rotor blade airfoil portion 132 that extends radially outward from inner blade attachment mechanism 134 to a rotor blade tip portion 136. Compressor stages 124 cooperate with a motive or working fluid including, but not limited to, air, such that the motive fluid is compressed in succeeding stages 124.

In operation, compressor 102 is rotated by turbine 108 via rotor 110. Fluid collected from a low pressure or compressor upstream region 148 via plurality of stages 124 is channeled by rotor blade airfoil portions 132 towards stator blade assemblies 128. The fluid is compressed and a pressure of the fluid is increased as the fluid is channeled through flow path 118. More specifically, the fluid continues to flow through subsequent stages 124 with flow path 118 generally narrowing with successive stages 124 to facilitate compressing and pressurizing the fluid as it is channeled through flow path 118. Compressed and pressurized fluid is subsequently channeled into a high pressure or compressor downstream region 150 for use within turbine engine 100.

Figure 3:
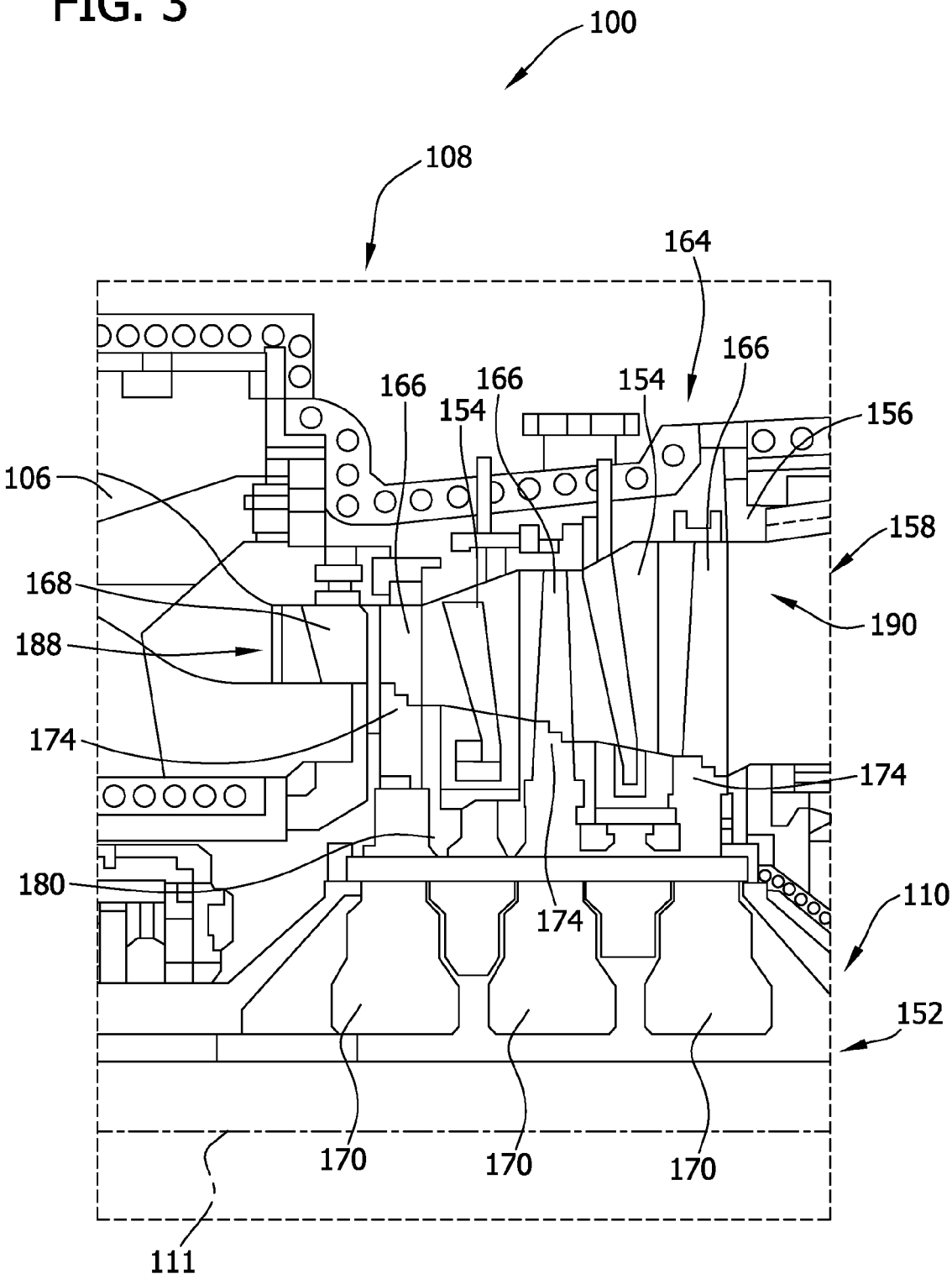
FIG. 3 is an enlarged cross-sectional view of a portion of a turbine that may be used with the gas turbine engine shown in FIG. 1 and taken along area 3.

FIG. 3 is an enlarged cross-sectional view of a portion of turbine 108 that may be used with gas turbine engine 100 and taken along area 3 (shown in FIG. 1). Turbine 108 includes a turbine rotor assembly 152. Turbine 108 also includes a plurality of stationary blades, or turbine diaphragm assemblies 154 that are positioned within a turbine casing 156 that at least partially defines a flow path 158. In the exemplary embodiment, turbine rotor assembly 152 forms a portion of rotor 110. Moreover, in the exemplary embodiment, turbine 108 is substantially symmetrical about rotor axial centerline 111. Also, in the exemplary embodiment, turbine 108 is a portion of gas turbine engine 100. Alternatively, turbine 108 is any rotating, bladed, multi-stage energy conversion apparatus including, but not limited to, a steam turbine.

Turbine 108 includes a plurality of stages 164, wherein each stage 164 includes a row of circumferentially-spaced rotor blade, or bucket assemblies 166 and a row of diaphragm assemblies 154, or a nozzle assembly 168. In the exemplary embodiment, turbine 108 includes three successive stages 164. Alternatively, turbine 108 includes any number of stages 164 that enables turbine engine 100 to function as described herein. Also, in the exemplary embodiment, bucket assemblies 166 are coupled to a turbine rotor wheel 170 via a stepped blade coupling or bucket attachment mechanism 174 such that each bucket assembly 166 extends radially outwardly from turbine rotor wheel 170. A plurality of turbine rotor wheels 170 and a plurality of stepped bucket attachment mechanisms 174 at least partially define a substantially divergent turbine hub 180. Turbine stages 164 cooperate with a motive or working fluid including, but not limited to, combustion gases, steam, and compressed air such that the motive fluid is expanded in succeeding stages 164.

In operation, in the exemplary embodiment, turbine 108 receives high pressure combustion gases generated by fuel nozzle assembly 106. Combustion gases collected from a high pressure or turbine upstream region 188 via nozzle assembly 168 is channeled by bucket assemblies 166 towards diaphragm assemblies 154. As the combustion gases are channeled through flow path 158, the combustion gases are at least partially decompressed and a pressure of the combustion gases is at least partially decreased. More specifically, the combustion gases continue to flow through subsequent stages 164 with flow path 158 generally expanding with successive stages 164 to facilitate decompressing and depressurizing the combustion gases as they are channeled through flow path 158. Decompressed and depressurized combustion gases are subsequently discharged into a low pressure region 150 for either further use within turbine engine 100 or exhaust from turbine engine 100.

Figure 4:
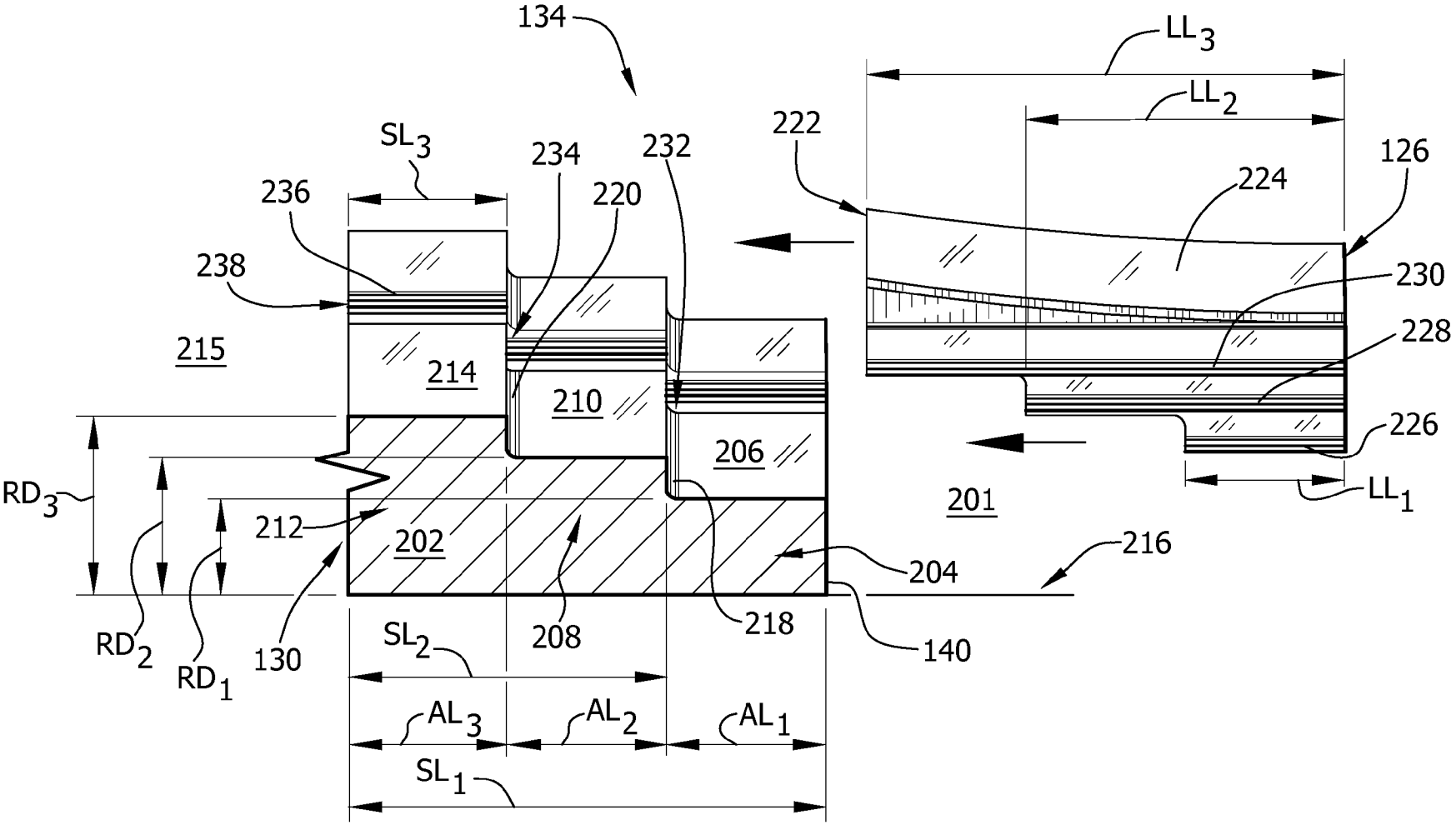
FIG. 4 is a perspective view of a portion of a partially assembled compressor blade attachment mechanism that may be used with the compressor shown in FIG. 2.

FIG. 4 is a perspective view of a portion of partially assembled compressor blade attachment mechanism 134 that may be used with compressor 102 (shown in FIG. 2). Compressor blade attachment mechanism 134 includes a rim section 202 of compressor wheel 130 positioned upstream of a low pressure, or upstream region 201. Rim section 202 includes a plurality of axially stepped regions, that is, a first axial rim step 204 having a first rim step surface 206 that at least partially defines step 204, a second axial rim step 208 having a second rim step surface 210 that at least partially defines step 208, and a third axial rim step 212 having a third rim step surface 214 that at least partially defines step 212. In the exemplary embodiment, each of rim step surfaces 206, 210, and 214 are substantially parallel to rotor axial centerline 111 (shown in FIGS. 1, 2, and 3). Alternatively, each of rim step surfaces 206, 210, and 214 have any orientation that enables compressor blade attachment mechanism 134 to function as described herein.

First axial rim step 204 and first rim step surface 206 are positioned axially downstream of low pressure region or upstream region 201. Moreover, first rim step surface 206 is positioned a first radial distance $RD_1$ radially outward of a compressor hub surface 216. Also, first axial rim surface 206 extends a first axial length $AL_1$ axially downstream from upstream region 201. In the exemplary embodiment, first axial length $AL_1$ and first radial distance $RD_1$ have any values that enable compressor blade attachment mechanism 134 to function as described herein.

Second axial rim step 208 and second rim step surface 210 are positioned axially downstream of first rim step 204 and first rim step surface 206. Moreover, second rim step surface 210 is positioned a second radial distance $RD_2$ radially outward of compressor hub surface 216, wherein $RD_2$ is greater than $RD_1$. Also, second rim surface 210 extends a second axial length $AL_2$ axially downstream from first rim step surface 206. First rim step surface 206 and second rim step surface 210 define a first interface region 218. In the exemplary embodiment, first interface region 218 is slightly rounded to facilitate fluid flow over first axial rim step 204 and second axial rim step 208. Also, in the exemplary embodiment, second axial length $AL_2$ and second radial distance $RD_2$ have any values that enable compressor blade attachment mechanism 134 to function as described herein.

Third axial rim step 212 and third rim step surface 214 are positioned axially downstream of second rim step 208 and second rim step surface 210. Moreover, third rim step surface 214 is positioned a third radial distance $RD_3$ radially outward of compressor hub surface 216, wherein $RD_3$ is greater than $RD_2$. Also, third rim surface 214 extends a third axial length $AL_3$ axially downstream from second rim step surface 210. Third rim step surface 214 and second rim step surface 210 define a second interface region 220. In the exemplary embodiment, first interface region 220 is slightly rounded to facilitate fluid flow over third axial rim step 212 and second axial rim step 208. Also, in the exemplary embodiment, third axial length $AL_3$ and third radial distance $RD_3$ have any values that enable compressor blade attachment mechanism 134 to function as described herein. Further, in the exemplary embodiment, axial rim steps 204, 208, and 212 cooperate to define compressor hub surface 216 as an ascending and convergent compressor hub surface 216. Moreover, in the exemplary embodiment, stepped rim section 202 includes three stepped regions as described above. Alternatively, stepped rim section 202 includes any number of stepped regions that enables compressor blade attachment mechanism 134 to function as described herein.

In the exemplary embodiment, compressor blade attachment mechanism 134 includes a dovetail section 222 of one of rotor blade assemblies 126. Dovetail section 222 includes an airfoil platform 224 that receives at least one of rotor blade airfoil portion 132 (shown in FIG. 2). Dovetail section 222 also includes a plurality of dovetail lobes, that is, a first dovetail lobe 226, a second dovetail lobe 228, and a third dovetail lobe 230. Also, in the exemplary embodiment, dovetail section 222 includes three dovetail lobes 226, 228, and 230. Alternatively, dovetail section 222 includes any number of dovetail lobes that enables compressor blade attachment mechanism 134 to function as described herein.

Further, in the exemplary embodiment, compressor blade attachment mechanism 134 includes a plurality of dovetail slots that receive dovetail lobes 226, 228, and 230. More specifically, rim section 202 defines a first dovetail slot 232, a second dovetail slot 234, and a third dovetail slot 236. Each of dovetail slots 232, 234, and 236 receives each of dovetail lobes 226, 228, and 230, respectively.

Also, in the exemplary embodiment, first dovetail slot 232 has a first axial slot distance, or length $SL_1$ that is substantially equal to a sum of first axial length $AL_1$, second axial length $AL_2$, and third axial length $AL_3$. Second dovetail slot 234 has a second axial slot distance, or length $SL_2$ that is substantially equal to a sum of second axial length $AL_2$ and third axial length $AL_3$. Third dovetail slot 236 has a third axial slot distance, or length $SL_3$ that is substantially equal to third axial length $AL_3$. First, second, and third axial slot lengths $SL_1$, $SL_2$, and $SL_3$, respectively, are substantially parallel to axial centerline 111. Moreover, first axial slot length $SL_1$ is greater than second axial slot length $SL_2$, and second axial slot length $SL_2$ is greater than third axial slot length $SL_3$. Therefore, second axial slot length $SL_2$ overlaps a portion of first axial slot length $SL_1$ by a distance that is approximately equal to a sum of second axial length $AL_2$ and third axial length $AL_3$, and third axial slot length $SL_3$ overlaps a portion of second axial slot length $SL_2$ by a distance that is approximately equal to third axial length $AL_3$. Dovetail slots 232, 234, and 236 are defined radially adjacent to each other to at least partially define a compressor wheel rim void 238. Further, in the exemplary embodiment, axial slot lengths $SL_1$, $SL_2$, and $SL_3$ have any values that enable compressor blade attachment mechanism 134 to function as described herein.

In the exemplary embodiment, dovetail lobes 226, 228, and 230 are coupled together and are radially disposed with respect to each other. First dovetail lobe 226 has a first axial lobe length $LL_1$ that is less than first axial slot length $SL_1$ and greater than or equal to first axial length $AL_1$. Second dovetail lobe 228 has a second axial lobe length $LL_2$ that is less than first axial slot length $SL_1$ and greater than second axial length $AL_2$. Third dovetail lobe 230 has a third axial lobe length $LL_3$ that is less than or equal to first axial slot length $SL_1$ and greater than third axial length $AL_3$. First, second, and third axial lobe lengths $LL_1$, $LL_2$, and $LL_3$, respectively, are substantially parallel to axial centerline 111. Moreover, in the exemplary embodiment, second axial lobe length $LL_2$ overlaps a portion of first axial lobe length $LL_1$ by a distance that is approximately equal to first axial lobe length $LL_1$ and third axial lobe length $LL_3$ overlaps a portion of second axial lobe length $LL_2$ by a distance that is approximately equal to second axial lobe length $LL_2$. Also, in the exemplary embodiment, axial lobe lengths $LL_1$, $LL_2$, and $LL_3$ have any values that enable compressor blade attachment mechanism 134 to function as described herein. Dovetail lobes 226, 228, and 230 cooperate with dovetail slots 232, 234, and 236, and stepped rim section 202 to define compressor wheel rim void 238.

Figure 5:
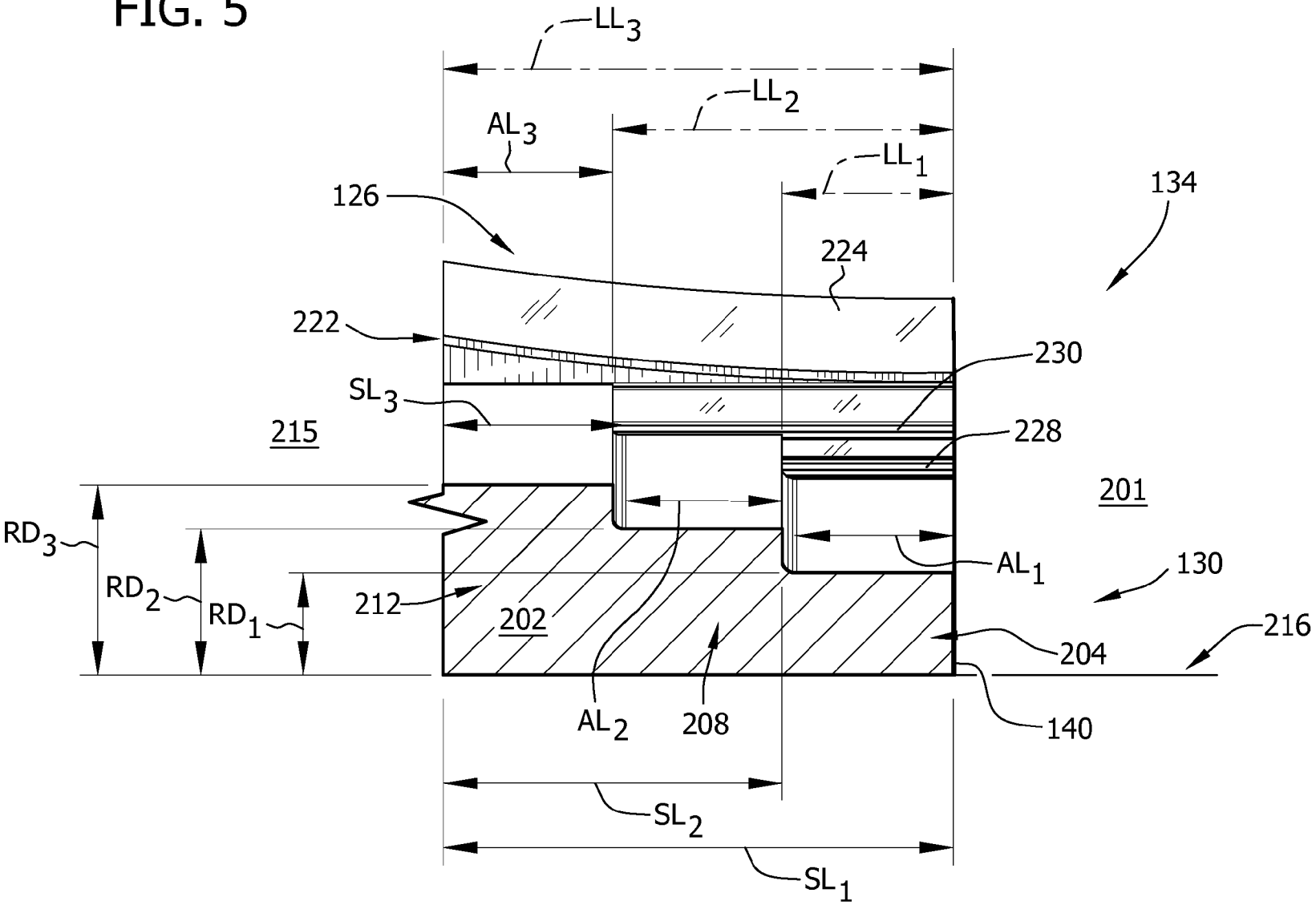
FIG. 5 is a perspective view of a portion of a fully assembled compressor blade attachment mechanism that may be used with the compressor shown in FIG. 2.

FIG. 5 is a perspective view of a portion of fully assembled compressor blade attachment mechanism 134 that may be used with compressor 102 (shown in FIG. 2). In the exemplary embodiment, dovetail lobes 226, 228, and 230 are fully inserted into dovetail slots 232, 234, and 236, respectively, such that dovetail lobes 228 and 229 axially extend from stepped rim section 202 toward low pressure, or upstream region 201. Therefore, first, second, and third axial lobe lengths $LL_1$, $LL_2$, and $LL_3$, respectively, are illustrated as both extending through first axial rim step 204, second axial rim step 208, and third axial rim step 212, respectively, as well as extending from stepped rim section 202 toward low pressure or upstream region 201.

In the exemplary embodiment, compressor blade attachment mechanism 134 facilitates assembling compressor 102 and gas turbine engine 100 by reducing an axial length necessary for axial installation and axial removal of rotor blade assemblies 126. Reducing such installation/removal length facilitates decreasing an overall length and weight of compressor 102, thereby facilitating a decrease in capital costs of construction of gas turbine engine 100. Moreover, the decreased weight of compressor 102 facilitates a decrease in centrifugal forces acting on rotor 110 for a range of operational speeds, thereby decreasing a potential for increased inspection and maintenance costs. Further, the decreased weight facilitates a decreased fuel usage to accelerate and maintain a speed of rotor 110, thereby decreasing operational costs.

Figure 6:
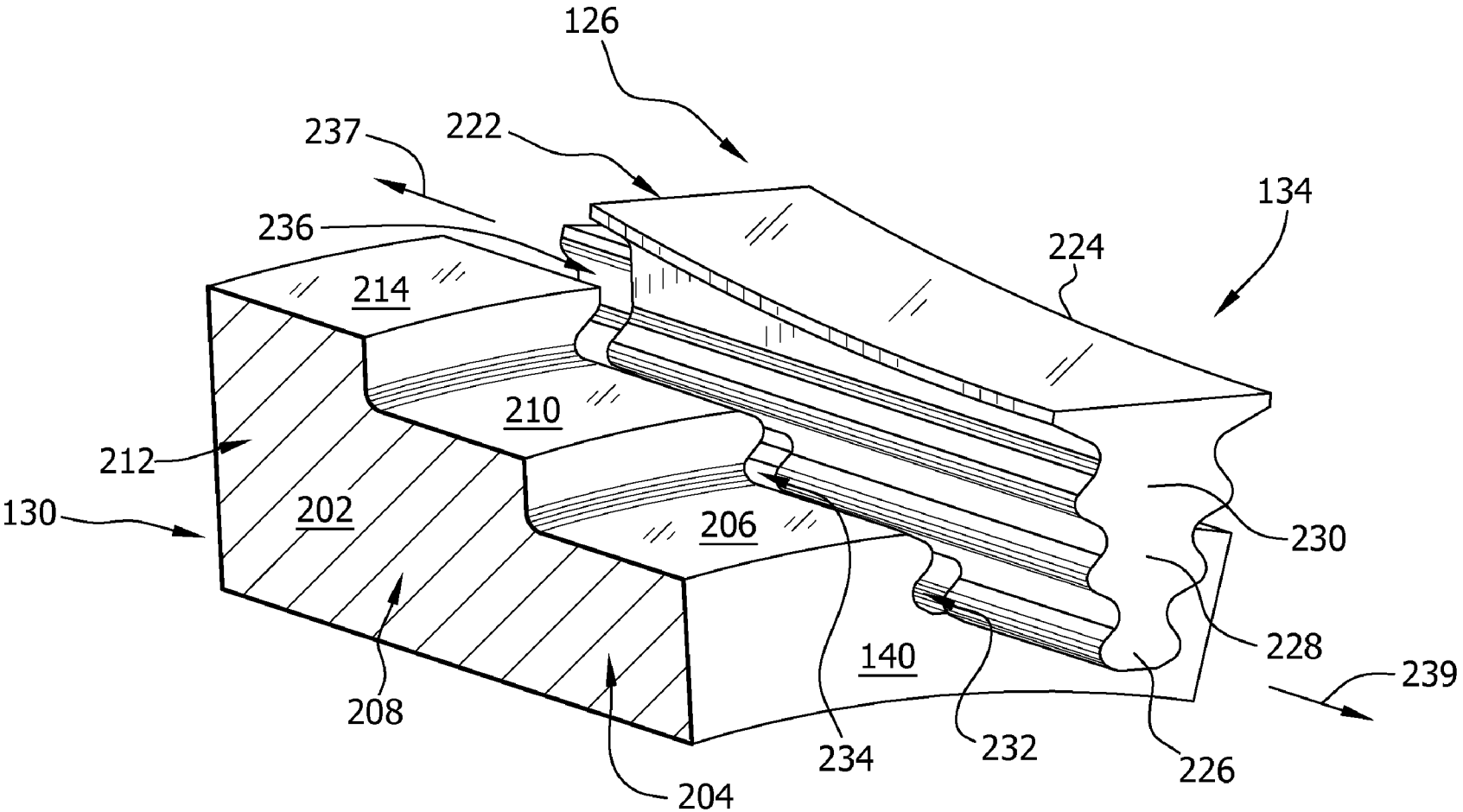
FIG. 6 is a perspective view of a portion of a partially assembled compressor blade attachment mechanism that may be used with the compressor shown in FIG. 2.

FIG. 6 is a perspective view of a portion of a partially assembled compressor blade attachment mechanism 134 that may be used with compressor 102 (shown in FIG. 2). FIG. 6 facilitates visual interpretation of the relationship of features of dovetail section 222 in relationship to features of stepped rim section 202. Specifically, an axial installation arrow 237 shows direction of movement of dovetail section 222 with respect to compressor hub 140 during assembly of gas turbine engine 100 (shown in FIGS. 1, 2, and 3), and more specifically, during assembly of compressor 102 (shown in FIGS. 1 and 2). An axial removal arrow 239 shows direction of movement of dovetail section 222 with respect to compressor hub 140 during disassembly of gas turbine engine 100, and more specifically, during disassembly of compressor 102.

Figure 7:
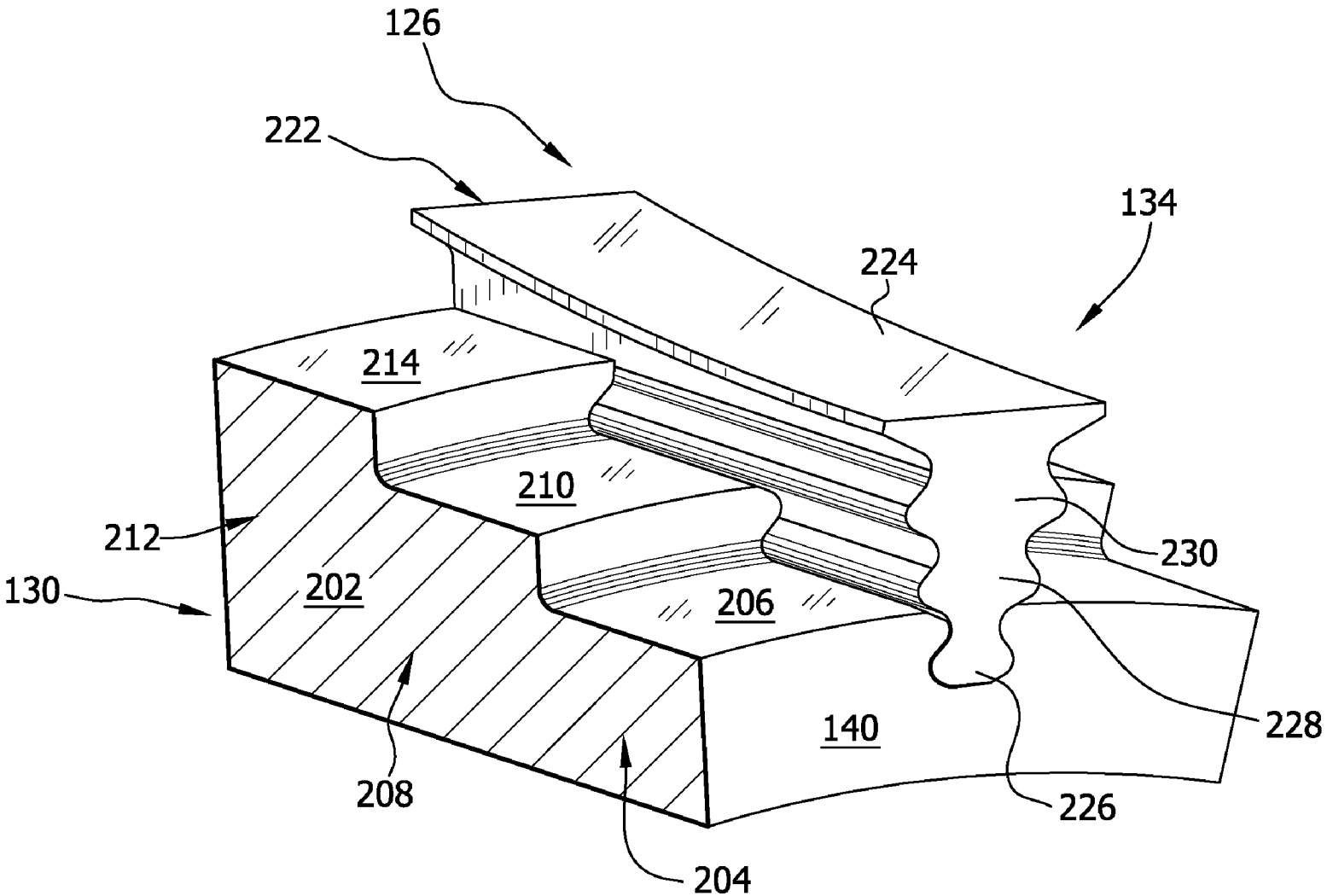
FIG. 7 is a perspective view of a portion of a fully assembled compressor blade attachment mechanism that may be used with the compressor shown in FIG. 2.

FIG. 7 is a perspective view of a portion of a fully assembled compressor blade attachment mechanism 134 that may be used with compressor 102 (shown in FIG. 2). FIG. 7 facilitates visual interpretation of the relationship of features of dovetail section 222 in relationship to features of stepped rim section 202. Specifically, dovetail section 222 is fully inserted within compressor hub 140 subsequent to assembly of gas turbine engine 100 (shown in FIGS. 1, 2, and 3), and more specifically, subsequent to assembly of compressor 102 (shown in FIGS. 1 and 2).

Figure 8:
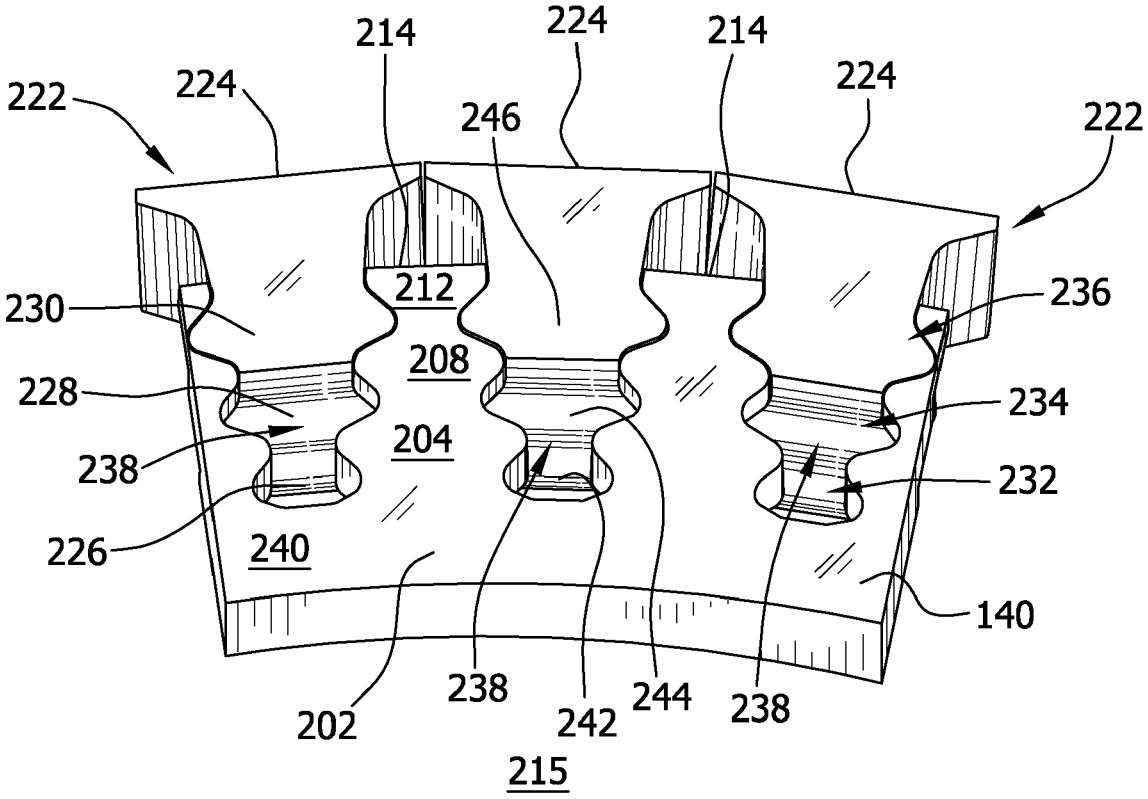
FIG. 8 is an perspective view of a portion of the fully assembled compressor blade attachment mechanism shown in FIG. 5 from a position upstream of the mechanism.

FIG. 8 is a perspective view of a portion of fully assembled compressor blade attachment mechanism 134 from a position upstream of mechanism 134, or more specifically, a high pressure or downstream region 215. Compressor wheel rim void 238 is at least partially defined by at least a portion of each of third dovetail lobe 230, second dovetail lobe 228, first dovetail lobe 226, first step 204, second step 208, and third step 212. In the exemplary embodiment, a downstream end 240 of stepped rim section 202 provides a reference for a downstream end 242 of first dovetail lobe 226 that is recessed a predetermined distance (not shown) axially upstream of downstream end 240 within first dovetail slot 232. Alternatively, downstream end 242 is substantially flush with downstream end 240.

Also, in the exemplary embodiment, a downstream end 244 of second dovetail lobe 228 is recessed a predetermined distance (not shown) axially upstream of downstream end 240 within second dovetail slot 234. Alternatively, downstream end 244 is substantially flush with downstream end 240. Further, in the exemplary embodiment, a downstream end 246 of third dovetail lobe 230 is substantially flush with downstream end 240. Alternatively, downstream end 246 is recessed a predetermined distance (not shown) axially upstream of downstream end 240 within third dovetail slot 236. Increasing a volume of compressor wheel rim void 238 facilitates decreasing a weight of compressor 102 with the associated benefits as described above.

In the exemplary embodiment, compressor blade attachment mechanism 134 includes one slot and one lobe per step. Alternatively, compressor blade attachment mechanism 134 includes any number of slots and lobes per step that enable mechanism 134 to function as described herein. For example, but not being limited to, mechanism 134 includes two steps, wherein each step includes two slots and two lobes (all not shown), and mechanism 134 includes two steps, wherein each step includes one slot and one lobe (all not shown). Moreover, for example, but not being limited to, mechanism 134 includes two steps, wherein a first step includes two slots and two lobes that extend through approximately ⅔ of the mechanism's axial length and a second step extends though approximately ⅓ of the mechanism's axial length (all not shown).

Figure 9:
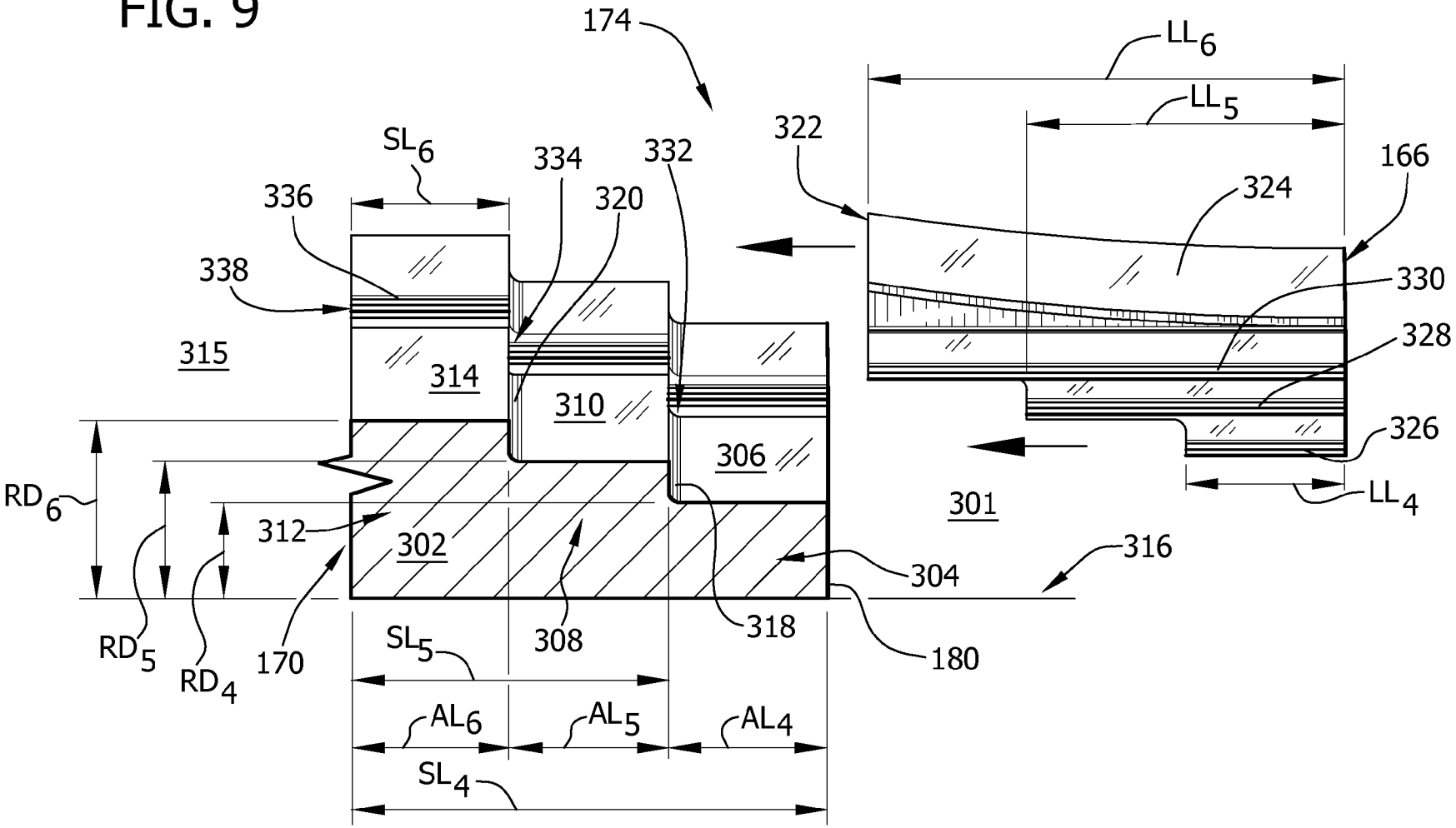
FIG. 9 is a perspective view of a portion of a partially assembled turbine bucket attachment mechanism that may be used with the turbine shown in FIG. 3.

FIG. 9 is a perspective view of a portion of partially assembled turbine bucket attachment mechanism 174 that may be used with turbine 108 (shown in FIG. 3). Turbine bucket attachment mechanism 174 includes a rim section 302 of turbine wheel 170 positioned upstream of a low pressure or downstream region 301. Rim section 302 includes a plurality of axially stepped regions, that is, a fourth axial rim step 304 having a fourth rim step surface 306 that at least partially defines step 304, a fifth axial rim step 308 having a fifth rim step surface 310 that at least partially defines step 308, and a sixth axial rim step 312 having a sixth rim step surface 314 that at least partially defines step 312. First, second, and third axial rim steps 204, 208, and 212, respectively, (all shown in FIGS. 4 and 5) and first, second, and third rim step surfaces 206, 210, and 214 (all shown in FIG. 4) are associated with compressor blade attachment mechanism 134 (shown in FIGS. 2, 4, 5, and 6). Each of rim step surfaces 306, 310, and 314 are substantially parallel to rotor axial centerline 111 (shown in FIGS. 1, 2, and 3). Alternatively, each of rim step surfaces 306, 310, and 314 have any orientation that enables turbine bucket attachment mechanism 174 to function as described herein.

Fourth axial rim step 304 and fourth rim step surface 306 are positioned axially downstream of low pressure region, or downstream region 301. Moreover, fourth rim step surface 306 is positioned a fourth radial distance $RD_4$ radially outward of a turbine hub surface 316, wherein first, second, and third radial distances $RD_1$, $RD_2$, and $RD_3$, respectively, (all shown in FIGS. 4 and 5) are associated with compressor blade attachment mechanism 134. Also, fourth axial rim surface 306 extends a fourth axial length $AL_4$ axially downstream from upstream region 301. First, second, and third axial lengths $AL_1$, $AL_2$, and $AL_3$, respectively, (all shown in FIGS. 4 and 5) are associated with compressor blade attachment mechanism 134. In the exemplary embodiment, fourth axial length $AL_4$ and fourth radial distance $RD_4$ have any values that enable turbine bucket attachment mechanism 174 to function as described herein.

Fifth axial rim step 308 and Fifth rim step surface 310 are positioned axially downstream of first rim step 304 and first rim step surface 306. Moreover, fifth rim step surface 310 is positioned a fifth radial distance $RD_5$ radially outward of turbine hub surface 316, wherein $RD_5$ is greater than $RD_4$. Also, fifth rim surface 310 extends a fifth axial length $AL_5$ axially downstream from first rim step surface 306. First rim step surface 306 and fifth rim step surface 310 define a third interface region 318. First and second interface regions 218 and 220, respectively, (both shown in FIG. 4) are associated with compressor blade attachment mechanism 134. In the exemplary embodiment, third interface region 318 is slightly rounded to facilitate fluid flow over first axial rim step 304 and fifth axial rim step 308. Also, in the exemplary embodiment, fifth axial length $AL_5$ and fifth radial distance $RD_5$ have any values that enable turbine bucket attachment mechanism 174 to function as described herein.

Sixth axial rim step 312 and sixth rim step surface 314 are positioned axially downstream of second rim step 308 and second rim step surface 310. Moreover, sixth rim step surface 314 is positioned a sixth radial distance $RD_6$ radially outward of turbine hub surface 316, wherein $RD_6$ is greater than $RD_5$. Also, sixth rim surface 314 extends a sixth axial length $AL_6$ axially downstream from second rim step surface 310. Sixth rim step surface 314 and second rim step surface 310 define a fourth interface region 320. In the exemplary embodiment, fourth interface region 320 is slightly rounded to facilitate fluid flow over sixth axial rim step 312 and second axial rim step 308. Also, in the exemplary embodiment, sixth axial length $AL_6$ and sixth radial distance $RD_6$ have any values that enable turbine bucket attachment mechanism 174 as described herein. Further, in the exemplary embodiment, axial rim steps 304, 308, and 312 cooperate to define turbine hub surface 316 as a descending and divergent turbine hub surface 316. Moreover, in the exemplary embodiment, stepped rim section 302 includes three stepped regions as described above. Alternatively, stepped rim section 302 includes any number of stepped regions that enables turbine bucket attachment mechanism 174 to function as described herein.

In the exemplary embodiment, turbine bucket attachment mechanism 174 includes a dovetail section 322 of one of bucket assemblies 166. Dovetail section 322 includes an airfoil platform 324 that receives at least one bucket airfoil portion (not shown). Dovetail section 322 also includes a plurality of dovetail lobes, that is, a fourth dovetail lobe 326, a fifth dovetail lobe 328, and a sixth dovetail lobe 330. First, second, and third dovetail lobes 226, 228, and 230, respectively, (all shown in FIGS. 4 and 5) are associated with compressor blade attachment mechanism 134. Also, in the exemplary embodiment, dovetail section 322 includes three dovetail lobes 326, 328, and 330. Alternatively, dovetail section 322 includes any number of dovetail lobes that enables turbine bucket attachment mechanism 174 to function as described herein.

Further, in the exemplary embodiment, turbine bucket attachment mechanism 174 includes a plurality of dovetail slots that receive dovetail lobes 326, 328, and 330. More specifically, rim section 302 defines a fourth dovetail slot 332, a fifth dovetail slot 334, and a sixth dovetail slot 336. First, second, and third dovetail slots 232, 234, and 236, respectively, (all shown in FIGS. 4 and 5) are associated with compressor blade attachment mechanism 134. Each of dovetail slots 332, 334, and 336 receives each of dovetail lobes 326, 328, and 330, respectively.

Also, in the exemplary embodiment, fourth dovetail slot 332 has a fourth axial slot length $SL_4$ that is substantially equal to a sum of fourth axial length $AL_4$, fifth axial length $AL_5$, and sixth axial length $AL_6$. First, second, and third axial slot lengths $SL_1$, $SL_2$, and $SL_3$, respectively, (all shown in FIGS. 4 and 5) are associated with compressor blade attachment mechanism 134. Fifth dovetail slot 334 has a fifth axial slot length $SL_5$ that is substantially equal to a sum of fifth axial length $AL_5$ and sixth axial length $AL_6$. Sixth dovetail slot 336 has a sixth axial slot length $SL_6$ that is substantially equal to sixth axial length $AL_6$. Fourth, fifth, and sixth axial slot lengths $SL_4$, $SL_5$, and $SL_6$, respectively, are substantially parallel to axial centerline 111. Moreover, fourth axial slot length $SL_4$ is greater than fifth axial slot length $SL_5$, and fifth axial slot length $SL_5$ is greater than sixth axial slot length $SL_6$. Therefore, fifth axial slot length $SL_5$ overlaps a portion of fourth axial slot length $SL_4$ by a distance that is approximately equal to a sum of fifth axial length $AL_5$ and sixth axial length $AL_6$, and sixth axial slot length $SL_6$ overlaps a portion of fifth axial slot length $SL_5$ by a distance that is approximately equal to sixth axial length $AL_6$. Dovetail slots 332, 334, and 336 are defined radially adjacent to each other to at least partially define a turbine wheel rim void 338. In the exemplary embodiment, axial slot lengths $SL_1$, $SL_2$, and $SL_3$ have any values that enable turbine bucket attachment mechanism 174 to function as described herein.

Also, in the exemplary embodiment, dovetail lobes 326, 328, and 330 are coupled together and are radially disposed with respect to each other. Fourth dovetail lobe 326 has a fourth axial lobe length $LL_4$ that is less than fourth axial slot length $SL_4$ and greater than or equal to fourth axial length $AL_4$. Fifth dovetail lobe 328 has a fifth axial lobe length $LL_5$ that is less than fourth axial slot length $SL_4$ and greater than fifth axial length $AL_5$. Sixth dovetail lobe 330 has a sixth axial lobe length $LL_6$ that is less than or equal to fourth axial slot length $SL_4$ and greater than sixth axial length $AL_6$. Fourth, fifth, and sixth axial lobe lengths $LL_4$, $LL_5$, and $LL_6$ are substantially parallel to axial centerline 111. Moreover, in the exemplary embodiment, fifth axial lobe length $LL_5$ overlaps a portion of fourth axial lobe length $LL_4$ by a distance that is approximately equal to fourth axial lobe length $LL_4$ and sixth axial lobe length $LL_6$ overlaps a portion of fifth axial lobe length $LL_5$ by a distance that is approximately equal to fifth axial lobe length $LL_5$. Further, in the exemplary embodiment, axial lobe lengths $LL_1$, $LL_2$, and $LL_3$ have any values that enable turbine bucket attachment mechanism 174 as described herein. Dovetail lobes 326, 328, and 330 cooperate with dovetail slots 332, 334, and 336, and stepped rim section 302 to define turbine wheel rim void 338.

Figure 10:
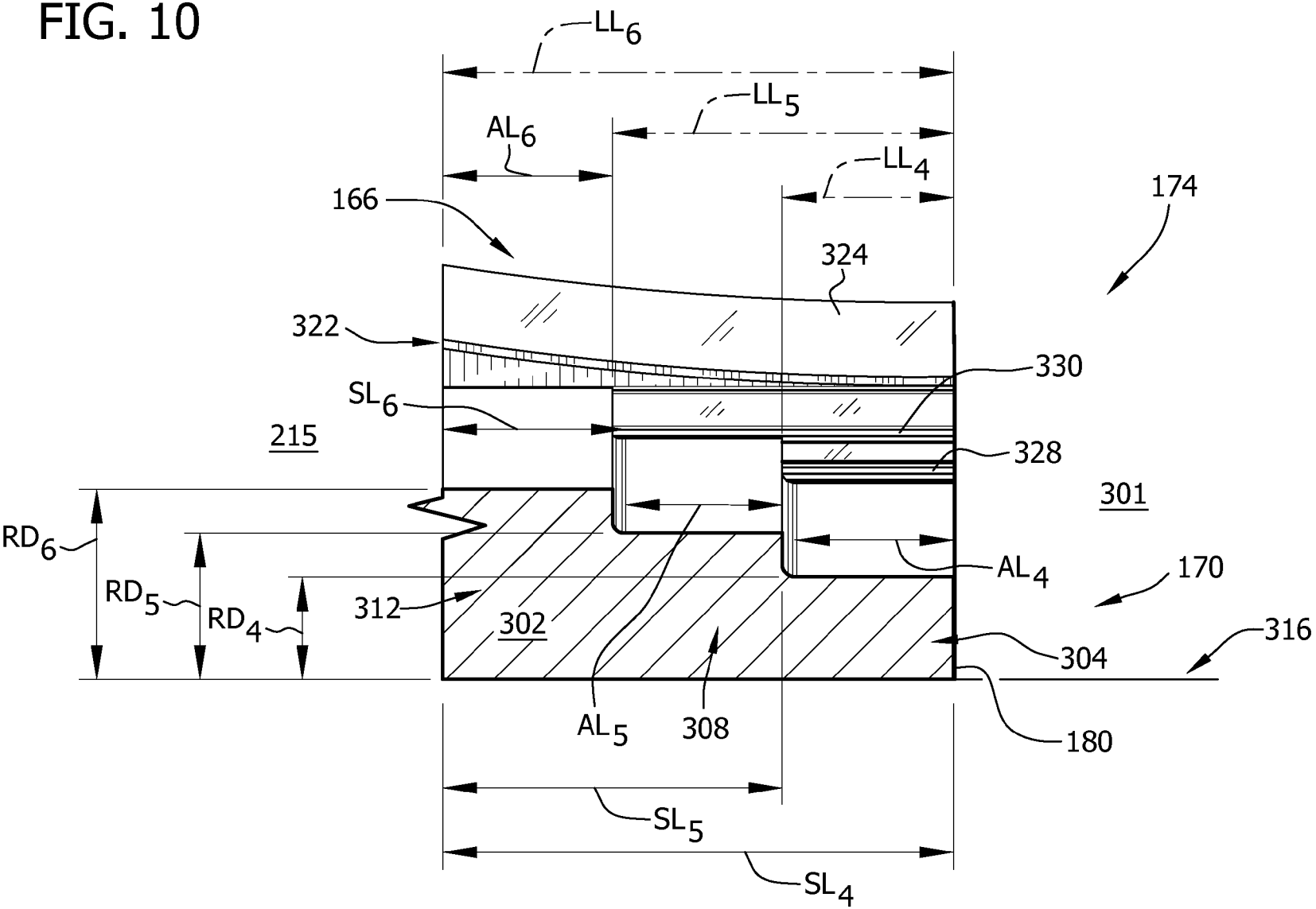
FIG. 10 is a perspective view of a portion of a fully assembled turbine bucket attachment mechanism that may be used with the turbine shown in FIG. 3.

FIG. 10 is a perspective view of a portion of fully assembled turbine bucket attachment mechanism 174 that may be used with turbine 108 (shown in FIG. 3). Dovetail lobes 326, 328, and 330 are fully inserted into dovetail slots 332, 334, and 336, respectively such that dovetail lobes 328 and 330 axially extend from stepped rim section 302 toward low pressure or downstream region 301. Therefore, axial lobe lengths $LL_1$, $LL_2$, and $LL_3$ are illustrated as both extending through fourth axial rim step 304, fifth axial rim step 308, and sixth axial rim step 312, respectively, as well as extending from stepped rim section 302 toward low pressure or downstream region 301.

In the exemplary embodiment, turbine bucket attachment mechanism 174 facilitates assembling turbine 108 and gas turbine engine 100 by reducing an axial length necessary for axial installation and axial removal of bucket assemblies 166. Reducing such installation/removal length facilitates decreasing an overall length and weight of turbine 108, thereby facilitating a decrease in capital costs of construction of gas turbine engine 100. Moreover, the decreased weight of turbine 108 facilitates a decrease in centrifugal forces acting on rotor 110 for a range of operational speeds, thereby decreasing a potential for increased inspection and maintenance costs. Further, the decreased weight facilitates a decreased fuel usage to accelerate and maintain a speed of rotor 110, thereby decreasing operational costs.

Also, in the exemplary embodiment, turbine bucket attachment mechanism 174 includes one slot and one lobe per step. Alternatively, turbine bucket attachment mechanism 174 includes any number of slots and lobes per step that enable mechanism 174 to function as described herein. For example, but not being limited to, mechanism 174 includes two steps, wherein each step includes two slots and two lobes (all not shown), and mechanism 174 includes two steps, wherein each step includes one slot and one lobe (all not shown). Moreover, for example, but not being limited to, mechanism 174 includes two steps, wherein a first step includes two slots and two lobes that extend through approximately ⅔ of the mechanism's axial length and a second step extends though approximately ⅓ of the mechanism's axial length (all not shown).

Figure 11:
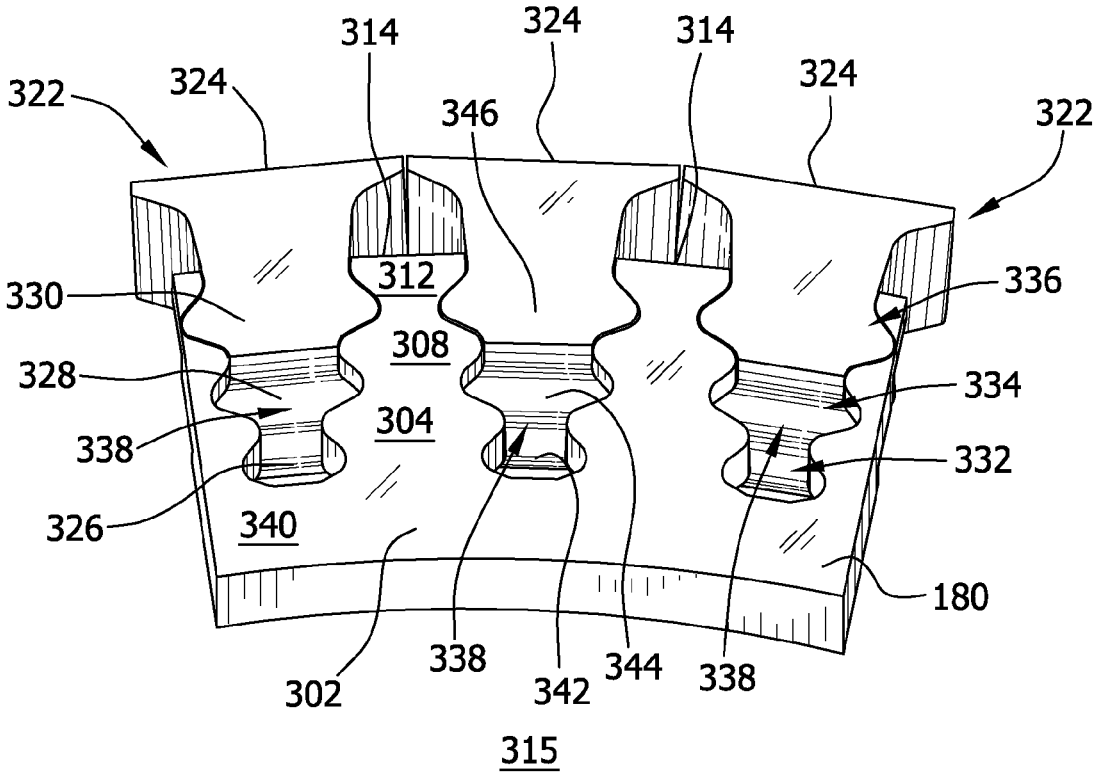
FIG. 11 is an perspective view of a portion of the fully assembled turbine bucket attachment mechanism shown in FIG. 8 from a position upstream of the mechanism.

FIG. 11 is a perspective view of a portion of fully assembled turbine bucket attachment mechanism 174 from a position upstream of mechanism 174, or more specifically, a high pressure or upstream region 315. Turbine wheel rim void 338 is at least partially defined by at least a portion of each of sixth dovetail lobe 330, fifth dovetail lobe 328, fourth dovetail lobe 326, fourth step 304, fifth step 308, and sixth step 312. In the exemplary embodiment, an upstream end 340 of stepped rim section 302 provides a reference for an upstream end 342 of fourth dovetail lobe 326 that is recessed a predetermined distance (not shown) axially downstream of upstream end 340 within fourth dovetail slot 332. Alternatively, upstream end 342 is substantially flush with upstream end 340.

Also, in the exemplary embodiment, an upstream end 344 of fifth dovetail lobe 328 is recessed a predetermined distance (not shown) axially downstream of upstream end 340 within fifth dovetail slot 334. Alternatively, upstream end 344 is substantially flush with upstream end 340. Further, in the exemplary embodiment, an upstream end 346 of sixth dovetail lobe 330 is substantially flush with upstream end 340. Alternatively, upstream end 346 is recessed a predetermined distance (not shown) axially downstream of upstream end 340 within sixth dovetail slot 336. Increasing a volume of turbine wheel rim void 338 facilitates decreasing a weight of turbine 108 with the associated benefits as described above.

Figure 12:
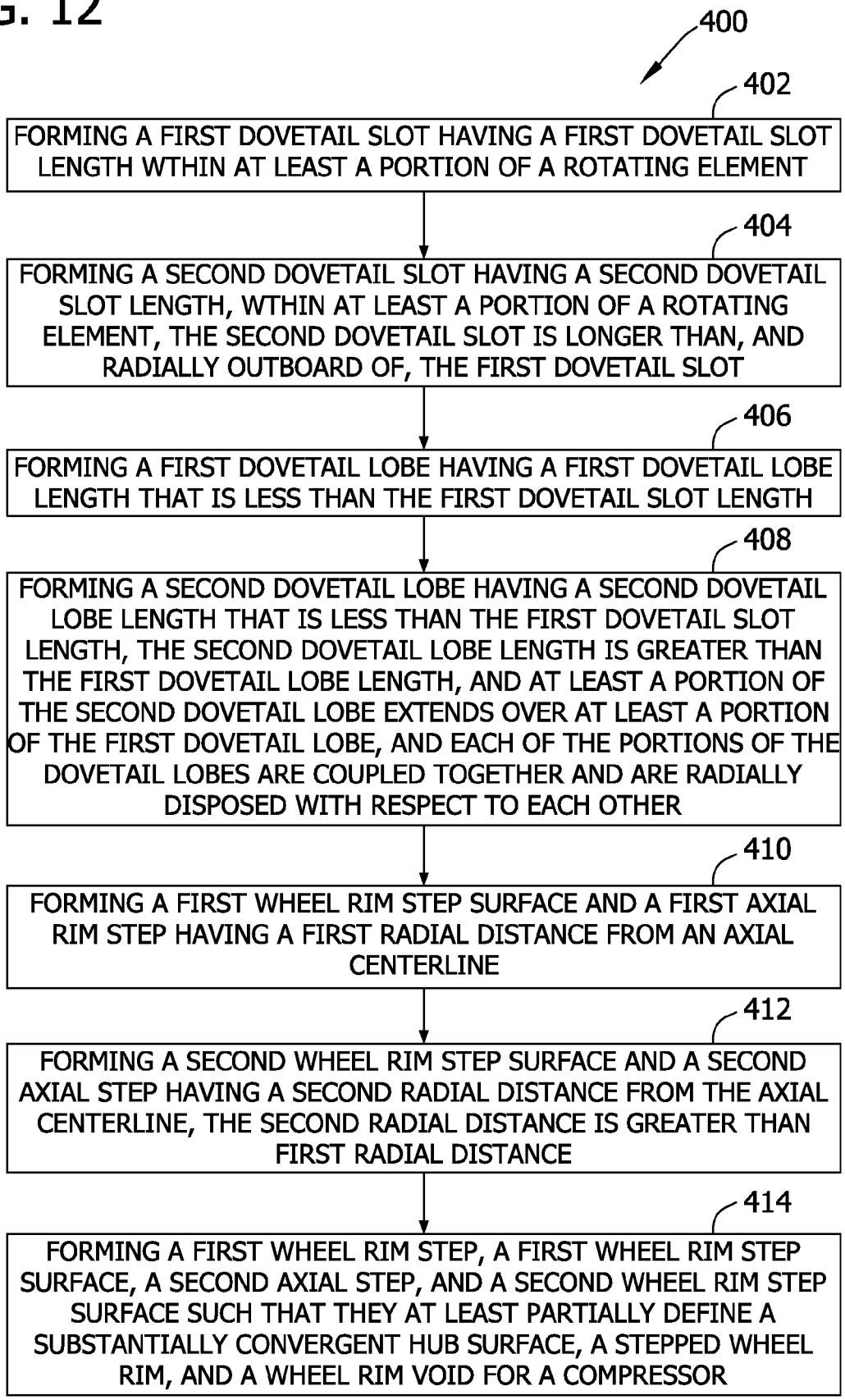
FIG. 12 is a flow chart illustrating an exemplary method of assembling a portion of the gas turbine engine shown in FIG. 1.

FIG. 12 is a flow chart illustrating an exemplary method 400 of assembling a portion of gas turbine engine 100, that is, compressor 102 (both shown in FIG. 2). In the exemplary embodiment, a first dovetail slot 232 (shown in FIGS. 4, 6, and 8) is formed 402 having a first axial length or first dovetail slot length $SL_1$ (shown in FIGS. 4 and 5) within at least a portion of a rotating element, i.e., compressor rotor wheel 130 (shown in FIGS. 2, 4, 5, 6, and 7). First dovetail slot 232 is substantially parallel to axial centerline 111 (shown in FIGS. 1, 2, and 3). A second dovetail slot 234 (shown in FIGS. 4, 6, and 8) is formed 404 having a second axial length or second dovetail slot length $SL_2$ (shown in FIGS. 4 and 5) within at least a portion of compressor rotor wheel 130. Second dovetail slot 234 is substantially parallel to axial centerline 111. At least a portion of second dovetail slot 234 is radially outboard of at least a portion of first dovetail slot 232. First axial length, or first dovetail slot length $SL_1$, is greater than second axial length, or second dovetail slot length $SL_2$. Dovetail slots 232 and 234 are radially adjacent to each other.

Also, in the exemplary embodiment, a first dovetail lobe 226 (shown in FIGS. 4, 6, 7, and 8) is formed 406 having third axial length or first dovetail lobe length $LL_1$ (shown in FIGS. 4 and 5) that is less than first axial length or first dovetail slot length $SL_1$. A second dovetail lobe 228 (shown in FIGS. 4, 6, 7, and 8) is formed 408 having a fourth axial length or second dovetail lobe length $LL_2$ (shown in FIGS. 4 and 5) that is less than first axial length or first dovetail slot length $SL_1$. Fourth axial length or second dovetail lobe length $LL_2$ is greater than third axial length or first dovetail lobe length $LL_1$. At least a portion of second dovetail lobe 228 extends over at least a portion of first dovetail lobe 226 and each of the portions of dovetail lobes 226 and 228 are coupled together and are radially disposed with respect to each other.

Further, in the exemplary embodiment, a first wheel rim step surface 206 and a first axial rim step 204 (both shown in FIGS. 4, 6, and 7) are at least partially formed 410 a first radial distance $RD_1$ (shown in FIGS. 4 and 5) from axial centerline 111. A second wheel rim step surface 210 and a second axial step 208 (both shown in FIGS. 4, 5, 6, and 7) are at least partially formed 412 a second radial distance $RD_2$ (shown in FIGS. 4 and 5) from axial centerline 111. Second radial distance $RD_2$ is greater than first radial distance $RD_1$.

Moreover, in the exemplary embodiment, first axial rim step 204, first wheel rim step surface 206, second axial step 208, and second wheel rim step surface 210 at least partially define 412 a substantially convergent hub surface 216 (shown in FIGS. 4 and 5), a wheel rim or stepped rim section 202, and a wheel rim void 238 (shown in FIGS. 4 and 8).

Figure 13:
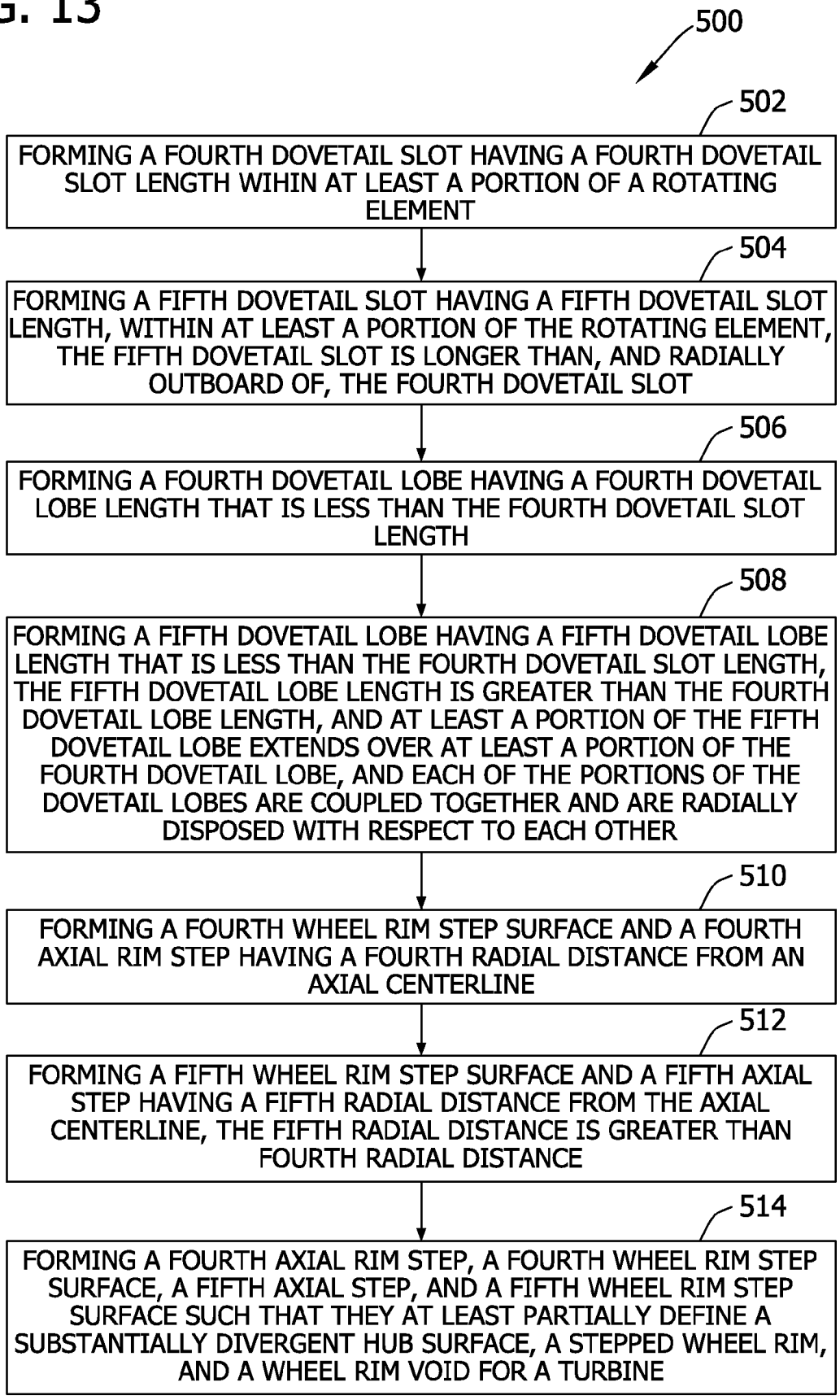
FIG. 13 is a flow chart illustrating an exemplary method of assembling another portion of the gas turbine engine shown in FIG. 1.

FIG. 13 is a flow chart illustrating an exemplary method 500 of assembling another portion of gas turbine engine 100, that is, turbine 108 (both shown in FIGS. 1 and 3). In the exemplary embodiment, a fourth dovetail slot 332 (shown in FIGS. 9 and 11) is formed 402 having a fourth axial length or first dovetail slot length $SL_4$ (shown in FIGS. 9 and 10) within at least a portion of a rotating element, i.e., turbine rotor wheel 170 (shown in FIGS. 3, 9, and 10). Fourth dovetail slot 332 is substantially parallel to axial centerline 111 (shown in FIGS. 1, 2, and 3). A fifth dovetail slot 334 (shown in FIGS. 9 and 11) is formed 504 having a fifth axial length or fifth dovetail slot length $SL_5$ (shown in FIGS. 9 and 10) within at least a portion of turbine rotor wheel 170. Fifth radial distance $RD_5$ is greater than fourth radial distance $RD_4$. Fifth dovetail slot 334 is substantially parallel to axial centerline 111. At least a portion of fifth dovetail slot 334 is radially outboard of at least a portion of fourth dovetail slot 332. Fourth axial length, or fourth dovetail slot length $SL_4$, is greater than fifth axial length, or fifth dovetail slot length $SL_5$. Dovetail slots 332 and 334 are radially adjacent to each other.

Also, in the exemplary embodiment, a fourth dovetail lobe 326 (shown in FIGS. 9 and 11) is formed 506 having fourth axial length or fourth dovetail lobe length $LL_4$ (shown in FIGS. 9 and 10) that is less than fourth axial length, or fourth dovetail slot length $SL_4$. A fifth dovetail lobe 328 (shown in FIGS. 9 and 11) is formed 508 having a fifth axial length or fifth dovetail lobe length $LL_5$ (shown in FIGS. 9 and 10) that is less than fourth axial length, or fourth dovetail slot length $SL_4$. Fifth axial length, or fifth dovetail lobe length $LL_5$, is greater than fourth axial length, or fourth dovetail lobe length $LL_4$. At least a portion of fifth dovetail lobe 328 extends over at least a portion of fourth dovetail lobe 326 and each of the portions of dovetail lobes 326 and 328 are coupled together and are radially disposed with respect to each other.

Further, in the exemplary embodiment, a fourth wheel rim step surface 306 and a fourth axial rim step 304 (both shown in FIG. 9) are at least partially formed 510 a fourth radial distance $RD_4$ (shown in FIGS. 9 and 10) from axial centerline 111. A fifth wheel rim step surface 310 and a fifth axial step 308 (both shown in FIG. 9) are at least partially formed 512 a fifth radial distance $RD_5$ (shown in FIGS. 9 and 10) from axial centerline 111.

Moreover, in the exemplary embodiment, fourth axial rim step 304, fourth wheel rim step surface 306, fifth axial step 308, and fifth wheel rim step surface 310 at least partially define 514 a substantially divergent hub surface 316 (shown in FIGS. 9 and 10), a wheel rim or stepped rim section 302, and wheel rim void 338 (shown in FIGS. 9 and 11).

Described herein are exemplary embodiments of methods and systems that facilitate assembling rotating apparatus, and more specifically, compressors and turbines, including steam turbines and gas turbines. Further, specifically, both compressor blade and turbine bucket attachment mechanisms facilitate assembling a compressor and a turbine, respectively, and gas turbine engines by reducing an axial length necessary for axial installation and axial removal of blade and bucket assemblies, respectively. Reducing such installation/removal lengths facilitates decreasing an overall length and weight of compressors and turbines, thereby facilitating a decrease in capital costs of construction of gas turbine engines. Moreover, the decreased weight of compressors and turbines facilitates a decrease in centrifugal forces acting on a common rotor for both compressors and turbines for a range of operational speeds, thereby decreasing a potential for increased inspection and maintenance costs. Further, the decreased weight facilitates a decreased fuel usage to accelerate and maintain a speed of the rotor, thereby decreasing operational costs. Also, increasing a volume of compressor and turbine wheel rim voids facilitates further decreasing a weight of gas turbine engines. Such benefits associated with decreased weight and length may also be realized in steam turbines.

The methods and systems described herein are not limited to the specific embodiments described herein. For example, components of each system and/or steps of each method may be used and/or practiced independently and separately from other components and/or steps described herein. In addition, each component and/or step may also be used and/or practiced with other assembly packages and methods.

While the invention has been described in terms of various specific embodiments, those skilled in the art will recognize that the invention can be practiced with modification within the spirit and scope of the claims.

What is claimed is:

1. A method for assembling a rotating machine, said method comprising:

providing a rotating element;

forming a first dovetail slot having a first axial length within a portion of the rotating element, wherein the first dovetail slot is substantially parallel to an axial centerline of the rotating element;

forming a second dovetail slot having a second axial length within a portion of the rotating element, the second dovetail slot is substantially parallel to the axial centerline of the rotating element, at least a portion of the second dovetail slot is radially outboard of at least a portion of the first dovetail slot, the first axial length is greater than the second axial length;

forming a first dovetail lobe having a third axial length that is shorter than the first axial length; and forming a second dovetail lobe having a fourth axial length that is shorter than the first axial length and that is longer than the third axial length, wherein at least a portion of the second dovetail lobe is radially outward from at least a portion of the first dovetail lobe; and enclosing at least a portion of the rotating element within at least a portion of a casing.

2. A method in accordance with claim 1, wherein:

forming a first dovetail slot comprises at least partially forming a first wheel rim surface a first radial distance from the axial centerline, wherein the first wheel rim surface is substantially parallel to the axial centerline of the rotating element; and forming a second dovetail slot comprises at least partially forming a second wheel rim surface a second radial distance from the axial centerline, wherein the second wheel rim surface is substantially parallel to the axial centerline of the rotating element, and the second radial distance is greater than the first radial distance.

3. A method in accordance with claim 2, wherein:

at least partially forming a first wheel rim surface comprises at least partially forming a first axial step; and at least partially forming a second wheel rim surface comprises at least partially forming a second axial step.

4. A method in accordance with claim 3, wherein at least partially forming a first wheel rim surface and at least partially forming a second wheel rim surface comprises at least one of:

forming a wheel rim for a compressor, the compressor wheel rim at least partially defines a substantially convergent hub; and forming a wheel rim for a turbine, the turbine wheel rim at least partially defines a substantially divergent hub.

5. A method in accordance with claim 4, wherein forming a wheel rim for a compressor or forming a wheel rim for a turbine comprises:

forming at least a portion of each of a plurality of dovetail lobes, each of the portions of the dovetail lobes are coupled together and are radially disposed with respect to each other;

forming at least a portion of each of a plurality of dovetail slots, each of the portions of the dovetail slots are radially adjacent to each other; and inserting at least a portion of each of the plurality of dovetail lobes into at least a portion of each of the plurality of dovetail slots.

6. A method in accordance with claim 5, wherein:

forming a wheel rim for a compressor comprises defining a compressor wheel rim void; and forming a wheel rim for a turbine comprises defining a turbine wheel rim void.

7. A blade attachment mechanism for a rotating machine having a rotating element having an axial centerline, said blade attachment mechanism at least partially formed within the rotating element, said blade attachment mechanism defining:

a first dovetail slot defining a first axial length parallel to the axial centerline;

a second dovetail slot defining a second axial length parallel to the axial centerline, wherein the first axial length is greater than the second axial length and at least a portion of said second dovetail slot is radially outward from at least a portion of the first dovetail slot;

a first dovetail lobe having a third axial length that is shorter than said first axial length; and a second dovetail lobe having a fourth axial length that is shorter than said first axial length, and that is longer than said third axial length, wherein at least a portion of said second dovetail lobe is radially outward from at least a portion of said first dovetail lobe.

8. A blade attachment mechanism in accordance with claim 7, wherein:

said first dovetail slot at least partially defines a first wheel rim surface, said first wheel rim surface at least partially defines a first radial distance from the axial centerline, wherein the first wheel rim surface is substantially parallel to the axial centerline of the rotating element; and said second dovetail slot at least partially defines a second wheel rim surface, said second wheel rim surface at least partially defines a second radial distance from the axial centerline, wherein the first wheel rim surface is substantially parallel to the axial centerline of the rotating element, the second radial distance is greater than the first radial distance.

9. A blade attachment mechanism in accordance with claim 8, wherein said first wheel rim surface at least partially defines a first axial step and said second wheel rim surface at least partially defines a second axial step.

10. A blade attachment mechanism in accordance with claim 9, wherein a plurality of axial steps at least partially defines at least one of:

a wheel rim for a compressor, said compressor wheel rim at least partially defines a substantially convergent hub; and a wheel rim for a turbine, said turbine wheel rim at least partially defines a substantially divergent hub.

11. A blade attachment mechanism in accordance with claim 10, wherein said substantially convergent hub comprises an axially downstream section comprising:

at least a portion of each of a plurality of dovetail lobes, each of said portions of said dovetail lobes are coupled together and are radially disposed with respect to each other; and at least a portion of each of a plurality of dovetail slots, each of said portions of said dovetail slots are radially adjacent to each other, said plurality of dovetail lobes and said plurality of dovetail slots at least partially define a compressor wheel rim void.

12. A blade attachment mechanism in accordance with claim 10, wherein said substantially divergent hub comprises an axially upstream section comprising:

at least a portion of each of a plurality of dovetail lobes, each of said portions of said dovetail lobes are coupled together and are radially disposed with respect to each other; and at least a portion of each of a plurality of dovetail slots, each of said portions of said dovetail slots are radially adjacent to each other, said plurality of dovetail lobes and said plurality of dovetail slots at least partially define a turbine wheel rim void.

13. A turbine engine comprising:

a rotating element having an axial centerline; and at least one blade attachment mechanism at least partially defined within at least a portion of said rotating element, said at least one blade attachment mechanism defining:

a first dovetail slot defining a first axial length parallel to the axial centerline;

a second dovetail slot defining a second axial length parallel to the axial centerline, wherein the first axial length is greater than the second axial length and at least a portion of said second dovetail slot is radially outward from at least a portion of the first dovetail slot;

a first dovetail lobe having a third axial length that is shorter than said first axial length; and a second dovetail lobe having a fourth axial length that is shorter than said first axial length and that is longer than said third axial length, wherein at least a portion of said second dovetail lobe is radially outward from at least a portion of said first dovetail lobe.

14. A turbine engine in accordance with claim 13, wherein:

said first dovetail slot at least partially defines a first wheel rim surface, said first wheel rim surface at least partially defines a first radial distance from the axial centerline, wherein the first wheel rim surface is substantially parallel to the axial centerline of the rotating element; and said second dovetail slot at least partially defines a second wheel rim surface, said second wheel rim surface at least partially defines a second radial distance from the axial centerline, wherein the second wheel rim surface is substantially parallel to the axial centerline of the rotating element, and the second radial distance is greater than the first radial distance.

15. A turbine engine in accordance with claim 14, wherein said first wheel rim surface at least partially defines a first axial step and said second wheel rim surface at least partially defines a second axial step.

16. A turbine engine in accordance with claim 15, wherein a plurality of axial steps at least partially defines a wheel rim for a compressor, said compressor wheel rim at least partially defines a substantially convergent hub, said substantially convergent hub comprises an axially downstream section comprising:

at least a portion of each of a plurality of dovetail lobes, each of said portions of said dovetail lobes are coupled together and are radially disposed with respect to each other; and at least a portion of each of a plurality of dovetail slots, each of said portions of said dovetail slots are radially adjacent to each other, said plurality of dovetail lobes and said plurality of dovetail slots at least partially define a compressor wheel rim void.

17. A turbine engine in accordance with claim 15, wherein a plurality of axial steps at least partially defines a wheel rim for a turbine, said turbine wheel rim at least partially defines a substantially divergent hub, said substantially divergent hub comprises an axially upstream section comprising:

at least a portion of each of a plurality of dovetail lobes, each of said portions of said dovetail lobes are coupled together and are radially disposed with respect to each other; and at least a portion of each of a plurality of dovetail slots, each of said portions of said dovetail slots are radially adjacent to each other, said plurality of dovetail lobes and said plurality of dovetail slots at least partially define a turbine wheel rim void.

* * * * *